US009981370B2

(12) United States Patent
Kela et al.

(10) Patent No.: US 9,981,370 B2
(45) Date of Patent: May 29, 2018

(54) BREAKING DEVICE

(71) Applicant: SANDVIK MINING AND CONSTRUCTION OY, Tampere (FI)

(72) Inventors: Timo Kela, Tampere (FI); Timo Muuttonen, Tampere (FI); Antti Koskimaki, Tampere (FI)

(73) Assignee: SANDVIK MINING and CONSTRUCTION OY, Tampere (FI)

( * ) Notice: Subject to any disclaimer, the term of this patent is extended or adjusted under 35 U.S.C. 154(b) by 368 days.

(21) Appl. No.: 14/789,618

(22) Filed: Jul. 1, 2015

(65) Prior Publication Data

US 2016/0001432 A1 Jan. 7, 2016

(30) Foreign Application Priority Data

Jul. 3, 2014 (EP) ..... 14175567

(51) Int. Cl.

| | |
|---|---|
| ***E21B 7/02*** | (2006.01) |
| ***B25D 9/14*** | (2006.01) |
| ***B25D 9/12*** | (2006.01) |
| ***B25D 9/18*** | (2006.01) |
| ***E21B 1/02*** | (2006.01) |
| ***B25D 9/20*** | (2006.01) |

(52) U.S. Cl.

CPC ..... *B25D 9/145* (2013.01); *B25D 9/12* (2013.01); *B25D 9/18* (2013.01); *B25D 9/20* (2013.01); *E21B 1/02* (2013.01); *E21B 7/025* (2013.01); *B25D 2250/275* (2013.01)

(58) Field of Classification Search

CPC . E21B 21/08; E21B 21/10; E21B 1/00; B25D 9/145; B25D 9/18; B25D 9/12; B25D 9/16

USPC ..... 173/13–17, 47, 79, 184–189, 218

See application file for complete search history.

(56) References Cited

U.S. PATENT DOCUMENTS 3,280,925 A * 10/1966 Becker ..... E21B 21/12 173/112
3,322,210 A 5/1967 Friedrich-Karl
3,741,072 A 6/1973 Romell et al.
(Continued)

FOREIGN PATENT DOCUMENTS

DE 2619606 A 11/1976
GB 1498305 A * 1/1978 ..... B25D 9/12
(Continued)

*Primary Examiner* — Robert Long
(74) *Attorney, Agent, or Firm* — Corinne R. Gorski

(57) ABSTRACT

A breaking device includes a frame, an impact device having a pressure chamber with a rear pressure chamber and a front pressure chamber. The breaking device further includes a first low pressure port at the rear pressure chamber, a first low pressure channel and a first low pressure accumulator connected to the first low pressure channel. The breaking device further includes a second low pressure port at the rear pressure chamber substantially opposite to the first low pressure port, second low pressure channel and a second low pressure accumulator connected to the second low pressure channel. The first low pressure accumulator and the second low pressure accumulator are arranged at the outer circumference of the frame of the breaking device at different positions in the axial direction of the breaking device.

9 Claims, 2 Drawing Sheets

(56) References Cited

U.S. PATENT DOCUMENTS

| | | | | |
|---|---|---|---|---|
| 3,887,018 | A * | 6/1975 | Jayne | B25D 9/06 173/120 |
| 3,896,889 | A | 7/1975 | Bouyoucos | |
| 3,911,789 | A | 10/1975 | Bouyoucos | |
| 4,022,108 | A | 5/1977 | Juvonen | |
| 4,039,033 | A | 8/1977 | Salmi | |
| 5,273,124 | A * | 12/1993 | Lloyd | E21B 3/02 173/185 |
| 5,875,857 | A | 3/1999 | Leppanen et al. | |
| 6,073,706 | A | 6/2000 | Niemi | |
| 6,315,059 | B1 * | 11/2001 | Geldean | E21B 7/028 173/112 |
| 7,387,173 | B2 * | 6/2008 | Jinnings | E02D 7/10 173/147 |
| 2003/0006052 | A1 | 1/2003 | Campbell | |
| 2006/0213676 | A1 * | 9/2006 | Jinnings | E02D 7/10 173/184 |
| 2010/0059242 | A1 | 3/2010 | Koskimaki et al. | |
| 2011/0155403 | A1 * | 6/2011 | Rohrer | E02D 7/10 173/114 |
| 2014/0102740 | A1 * | 4/2014 | Jagdale | E02F 3/966 173/114 |
| 2014/0208575 | A1 * | 7/2014 | Jagdale | E02F 3/966 29/525.02 |
| 2014/0367133 | A1 * | 12/2014 | Kuzma | B25D 17/005 173/105 |
| 2015/0013794 | A1 * | 1/2015 | Dirr | E21B 4/14 137/596 |
| 2015/0197988 | A1 | 7/2015 | Lee | |
| 2016/0221170 | A1 * | 8/2016 | Moore | B25D 9/145 |

FOREIGN PATENT DOCUMENTS

| | | | |
|---|---|---|---|
| GB | 1536494 | A | 12/1978 |
| KR | 1020100039036 | A | 12/2010 |
| KR | 1020110051975 | A | 10/2011 |

* cited by examiner

BREAKING DEVICE

RELATED APPLICATION DATA

This application claims priority under 35 U.S.C. § 119 to EP Patent Application No. 14175567.8, filed on Jul. 3, 2014, which the entirety thereof is incorporated herein by reference.

TECHNICAL FIELD

The present disclosure relates to a breaking device, such as a rock drilling machine or a breaking hammer.

BACKGROUND

Breaking devices, such as rock drilling machines and breaking hammers, include an impact device, which is intended to provide impact pulses to a tool for breaking material being operated. The impact device has a percussion piston, which is a reciprocating object allowed to move towards an impact direction and in a return direction.

The breaking device has a pressure chamber into which the percussion piston is inserted, the percussion piston dividing the pressure chamber into a rear pressure chamber and a front pressure chamber. For moving the percussion piston into the impact direction, a high pressure is provided into the rear pressure chamber. For moving the percussion piston back, i.e. towards the return direction, a low pressure is provided in the rear pressure chamber, whereby the percussion piston moves back by an effect of a high pressure remaining constantly in the front pressure chamber.

Due to a continuous variation of the pressure of a pressure medium in the rear pressure chamber, cavitation may occur in the rear pressure chamber. The cavitation may, in turn, cause harmful deterioration of the frame of the breaking device or parts of the impact device by causing small pieces of metal to come off from the frame of the breaking device or from the parts of the impact device. This may eventually lead to a leakage of pressure medium via a hole appearing through the wall of the frame of the breaking device or malfunctions of the breaking device because of loose pieces entering between moving parts in the impact device.

SUMMARY

An object of the present disclosure is to provide a novel and improved breaking device.

According to an embodiment of the breaking device, the breaking device includes a frame, an impact device having a pressure chamber and a percussion piston, which is an elongated object contributing to dividing the pressure chamber into a rear pressure chamber and a front pressure chamber, at least one first low pressure port in the frame at the rear pressure chamber and at least one first low pressure channel extending from the at least one first low pressure port to an outer circumference of the frame of the breaking device, at least one first low pressure accumulator connected to the at least one first low pressure channel at the outer circumference of the frame of the breaking device, at least one second low pressure port in the frame at the rear pressure chamber substantially opposite to the at least one first low pressure port and at least one second low pressure channel extending from the at least one second low pressure port to the outer circumference of the frame of the breaking device, and at least one second low pressure accumulator connected to the at least one second low pressure channel at the outer circumference of the frame of the breaking device. The at least one second low pressure channel is arranged to extend at least partly in an axial direction of the breaking device, whereby the at least one first low pressure accumulator and at least one second low pressure accumulator are arranged at the outer circumference of the frame of the breaking device at different positions in the axial direction of the breaking device.

According to an embodiment of the breaking device, the at least one second low pressure channel is arranged to extend in the axial direction of the breaking device from the at least one second low pressure port towards the front pressure chamber, whereby the at least one first low pressure accumulator and at least one second low pressure accumulator are arranged at the outer circumference of the frame of the breaking device at substantially opposite positions in the radial direction of the frame of the breaking device.

According to an embodiment of the breaking device, the at least one first low pressure channel is arranged to extend substantially in a radial direction of the frame of the breaking device from the at least one first low pressure port to the outer circumference of the frame of the breaking device and the at least one second low pressure channel is arranged to extend at a position of the front pressure chamber, whereby the at least one first low pressure accumulator is positioned at the rear pressure chamber and the at least one second low pressure accumulator is positioned at the front pressure chamber.

According to an embodiment of the breaking device, the breaking device includes at least one first high pressure port in the frame at the front pressure chamber and at least one first high pressure channel extending from the at least one first high pressure port to the outer circumference of the frame of the breaking device, at least one first high pressure accumulator connected to the at least one first high pressure channel at the outer circumference of the frame of the breaking device, at least one second high pressure port in the frame at the rear pressure chamber and at least one second high pressure channel extending from the at least one second high pressure port to the outer circumference of the frame of the breaking device, and at least one second high pressure accumulator connected to the at least one second high pressure channel at the outer circumference of the frame of the breaking device, and wherein the at least one first high pressure channel and the at least one second high pressure channel are arranged to extend substantially in the radial direction of the frame of the breaking device from the at least one first high pressure port and from the at least second high pressure port to the outer circumference of the frame of the breaking device, whereby the at least one first high pressure accumulator is positioned at the front pressure chamber and the at least one second high pressure accumulator is positioned at the rear pressure chamber.

According to an embodiment of the breaking device, the at least one first high pressure port and the at least one second high pressure port are arranged at substantially opposite positions in the radial direction of the frame of the breaking device.

According to an embodiment of the breaking device, in the axial direction of the breaking device, the at least one first low pressure accumulator and the at least one second low pressure accumulator, as well as the at least one first high pressure accumulator and the at least one second high pressure accumulator are positioned mutually crosswise at substantially opposite positions in the radial direction of the frame of the breaking device.

According to an embodiment of the breaking device, the impact device includes at least one control valve contributing to divide the pressure chamber into the rear pressure chamber and the front pressure chamber and comprising a number of openings for controlling the flow of pressure medium in the rear pressure chamber through low pressure ports and high pressure ports.

According to an embodiment of the breaking device, the control valve is positioned between the percussion piston and a stationary cylinder comprising openings, and the control valve is arranged to move in respect of the cylinder for controlling the flow of the pressure medium through the openings and thereby through the ports for controlling the pressure affecting in the rear pressure chamber.

According to an embodiment of the breaking device, the breaking device is a rock drilling machine.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE DRAWINGS

For the sake of clarity, the figures show some embodiments of the disclosed solution in a simplified manner. In the figures, like reference numerals identify like elements.

DETAILED DESCRIPTION

Figure 1:
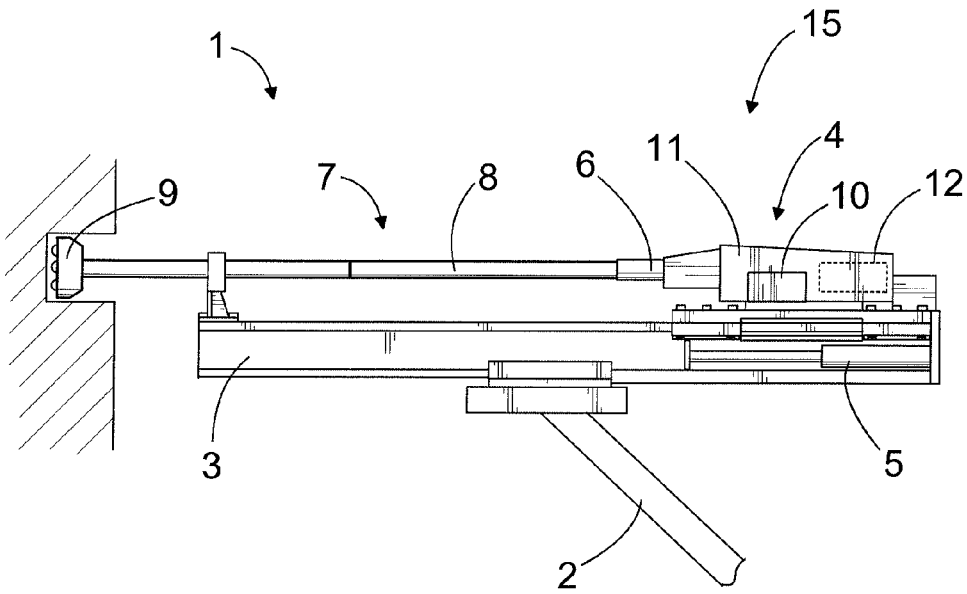
FIG. 1 is a schematic side view showing a rock drilling machine arranged on a feed beam.

FIG. 1 shows a feasible rock drilling unit 1, which may be connected by a boom 2 to a movable carrier, which is not shown. The drilling unit 1 may include a feed beam 3 and a rock drilling machine 4 supported on it. The rock drilling machine 4 can be moved on the feed beam 3 by a feed device 5.

The rock drilling machine 4 includes a shank 6 at a front end of the rock drilling machine 4 for connecting a tool 7. The tool 7 may have one or more drill rods 8 and a drill bit 9 located at a distal end of the tool 7. The rock drilling machine 4 may further include a rotating device 10 for rotating the shank 6 and the tool 7 connected to the shank 6. Inside a frame 11 of the rock drilling machine 4 is an impact device 12 including a reciprocating percussion piston for generating impact pulses to the tool 7.

At a drilling site, one or more drill holes are drilled with the rock drilling unit 1. The drill holes may be drilled in a horizontal direction, as shown in FIG. 1, or in a vertical direction, or in any direction between the horizontal direction and the vertical direction. The disclosed solution is known as top-hammer drilling. The features disclosed in this application may be applied in such drilling machines.

In an alternative drilling solution, which is known as down-the-hole or DTH-drilling, the impact device is located inside a bore hole. In this manner, the impact device and a rotating device are located at opposite ends of the drilling equipment. The features disclosed in this application may also be applied in drilling machines of this type.

Figure 2:
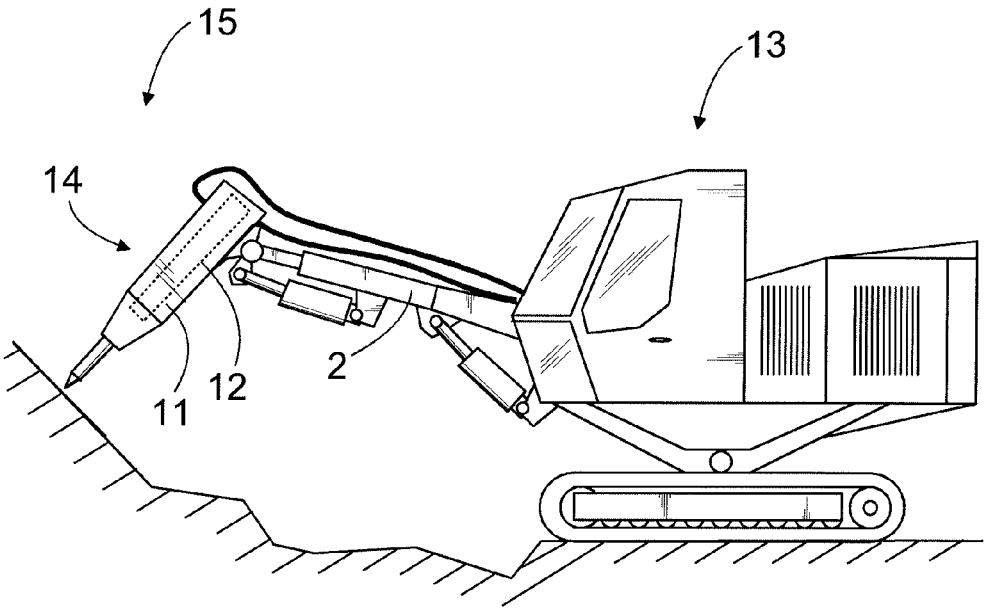
FIG. 2 is a schematic side view showing a breaking hammer arranged at a distal end of a boom of an excavator.

FIG. 2 discloses an excavator 13 provided with a boom 2. At a distal end of the boom 2 there is a breaking hammer 14, which includes an impact device 12 arranged inside frame 11 of the breaking hammer 14. The impact device 12 may be in accordance with the solution disclosed in this application.

In FIGS. 1 and 2, thus, two different breaking devices 15, namely the rock drilling machine 4 and the breaking hammer 14, are shown. The solution disclosed in this description may be utilized in both kind of breaking devices. In the following, the solution is explained as implemented in a rock drilling machine 4. However, the solution may be implemented correspondingly in breaking hammers 14.

Figure 3:
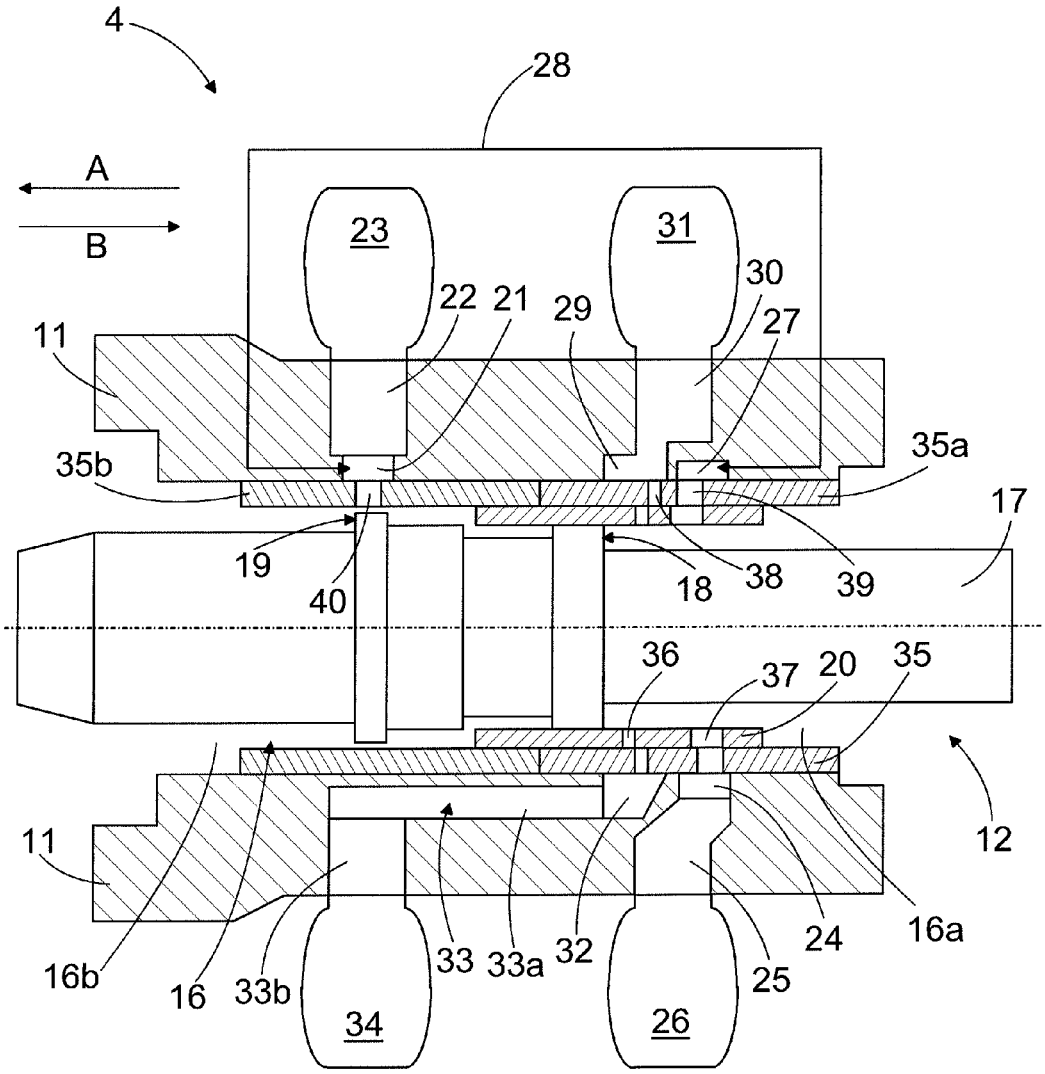
FIG. 3 is a schematic cross-sectional side view of a rear portion of a rock drilling machine and an impact device of the rock drilling machine.

FIG. 3 shows a schematic cross-sectional side view of a rear portion of a rock drilling machine 4 and an impact device 12 of the rock drilling machine 4. The rock drilling machine 4 includes the frame 11 and the impact device 12 having a pressure chamber 16. The impact device 12 further includes a percussion piston 17, which is an elongated object contributing to dividing the pressure chamber 16 into a rear pressure chamber **16*a* and a front pressure chamber 16*b* when arranged in the pressure chamber 16 of the impact device 12**.

During operation the percussion piston 17 is moved forwards in an impact direction A for striking a tool and is moved backwards in a return direction B, the percussion piston 17 thus moving in an axial direction of the rock drilling machine 4. Thus, the percussion piston 17 is reciprocating during a work cycle of the impact device 12. The impact device 12 is hydraulically operated whereby the percussion piston 17 includes one or more first working pressure surfaces 18 affecting in the impact direction A and one or more second working pressure surfaces 19 affecting in the return direction B. The percussion piston 17 is moved back and forth by changing hydraulic pressure acting on the working pressure surfaces.

The rock drilling machine 4 of FIG. 3 comprises further has at least one first high pressure port 21 in the frame 11 of the rock drilling machine 4 at the front pressure chamber **16*b* and at least one first high pressure channel 22 extending from the at least one first high pressure port 21 to the outer circumference of the frame 11 of the rock drilling machine 4. At the outer circumference of the frame 11 of the rock drilling machine 4 there is at least one first high pressure accumulator 23 connected to the at least one first high pressure channel 22**.

Further, the rock drilling machine 4 of FIG. 3 includes at least one second high pressure port 24 in the frame 11 of the rock drilling machine 4 at the rear pressure chamber **16*a* and at least one second high pressure channel 25 extending from the at least one second high pressure port 24 to the outer circumference of the frame 11 of the rock drilling machine 4. At the outer circumference of the frame 11 of the rock drilling machine 4 there is at least one second high pressure accumulator 26 connected to the at least one second high pressure channel 25**.

In the embodiment of FIG. 3, the front pressure chamber **16*b* and the rear pressure chamber 16*a* are connected to each other through a third high pressure port 27 at the rear pressure chamber 16*a* and a connecting channel 28 arranged between the first high pressure port 21 and the third high pressure port 27, as shown schematically by an arrow indicated with the reference sign 28. In practice, the connecting channel 28 may be arranged in the frame 11 of the rock drilling machine 4**.

Hydraulic pressures affecting the first working pressure surfaces 18 in the rear pressure chamber **16*a* and the second working pressure surfaces 19** in the front pressure chamber

16*b* are controlled by a control valve 20, which may also contribute to divide the pressure chamber 16 into the rear pressure chamber 16*a* and the front pressure chamber 16*b*. Hydraulic pressures affecting the second working surfaces 19 in the front pressure chamber 16*b* and in the rear pressure chamber 16*a* may thus be affected by the control valve 20 through the connecting channel 28. The control of the working cycle of the percussion piston 17 is generally known to a person skilled in the art and is therefore not described in more detail.

The purpose of the first high pressure accumulator 23 is to maintain high pressure in the front pressure chamber 16*b* for providing an effective return movement of the percussion piston 17. The purpose of the second high pressure accumulator 26 is to provide an auxiliary high hydraulic pressure in the rear pressure chamber 16*a* for intensifying the impact movement of the percussion piston 17. The high pressure accumulators will thus increase a working operating efficiency of the impact device 12. The actual adjustments or settings of pre-charge pressures in the first 23 and second 26 high pressure accumulators are selected such that a proper operation of the impact device 12 is achieved.

The at least one first high pressure channel 22 and the at least one second high pressure channel 25 are arranged to extend substantially in the radial direction of the frame 11 of the rock drilling machine 4 from the at least one first high pressure port 21 and from the at least one second high pressure port 24 to the outer circumference of the frame 11 of the rock drilling machine 4. The at least one first high pressure accumulator 23 is positioned at the front pressure chamber 16*b* and the at least one second high pressure accumulator 26 is positioned at the rear pressure chamber 16*a* and any pressure losses between the high pressure accumulators 23, 26 and the respective front 16*b* and rear 16*a* pressure chambers will remain at their minimum.

With the feature the radial direction of the frame of the rock drilling machine it is meant the direction from the centre of the frame 11 of the rock drilling machine 4 towards the outer circumference of the frame 11 of the rock drilling machine 4 and with the feature substantially in the radial direction of the rock drilling machine it is meant the direction which deviates not more than 45 degrees from the radial direction of the frame of the rock drilling machine.

The rock drilling machine 4 of FIG. 3 also includes at least one first low pressure port 29 in the frame 11 of the rock drilling machine 4 at the rear pressure chamber 16*a* and at least one first low pressure channel 30 extending from the at least one first low pressure port 29 to the outer circumference of the frame 11 of the rock drilling machine 4.

At the outer circumference of the frame 11 of the rock drilling machine 4 there is at least one first low pressure accumulator 31 connected to the at least one first low pressure channel 30.

Further the rock drilling machine 4 of FIG. 3 includes at least one second low pressure port 32 in the frame 11 of the rock drilling machine at the rear pressure chamber 16*a* substantially opposite to the at least one first low pressure port 29.

Further the rock drilling machine 4 includes at least one second low pressure channel 33 extending from the at least one second low pressure port 32 to the outer circumference of the frame 11 of the rock drilling machine 4, and at least one second low pressure accumulator 34 connected to the at least one second low pressure channel 33 at the outer circumference of the frame 11 of the rock drilling machine 4. The at least one second low pressure channel 33 is arranged to extend at least partly in the axial direction of the rock drilling machine 4, whereby the at least one first low pressure accumulator 31 and the at least one second low pressure accumulator 34 are arranged at the outer circumference of the frame 11 of the rock drilling machine 4 at different positions in the axial direction of the rock drilling machine 4.

When the rock drilling machine 4 is provided with at least two mutually, substantially radially opposite low pressure ports 29, 32, where low pressure accumulators 31, 34 are connected to, a cavitation effect, which typically is focused to a radially opposite position with respect to a single low pressure port, may be avoided.

With the feature substantially radially opposite it is meant that an angle between 170-190 degrees, preferably exactly 180 degrees, remains between the first 29 and the second 32 low pressure ports, whereby the cavitation effect may be successfully avoided. Further, when the at least one second low pressure channel 33 between the at least one second low pressure port 32 and the at least one second low pressure accumulator 34 is arranged to extend at least partly in the axial direction of the rock drilling machine 4, the actual position of the second low pressure accumulator 34 at the outer circumference of the frame 11 of the rock drilling machine 4 may be selected substantially freely with respect to other components, such as high pressure accumulators, mounted at the outer circumference of the frame 11 of the rock drilling machine 4. This is especially useful when updating old constructions of rock drilling machines originally having a single low pressure port in the rear pressure chamber 16*a*, but a need to add an additional low pressure port has arisen due to the cavitation effect, but the actual locations of other components at the outer circumference of the frame 11 of the rock drilling machine 4 does not allow an additional low pressure accumulator to be added exactly at the same position in the axial direction of the rock drilling machine 4 where the additional low pressure port has been located.

In the embodiment of FIG. 3 the at least one second low pressure channel 33 is arranged to extend in the axial direction of the rock drilling machine from the at least one second low pressure port 32 towards the front pressure chamber 16*b*, whereby the at least one first low pressure accumulator 31 and at least one second low pressure accumulator 34 are arranged at the outer circumference of the frame 11 of the rock drilling machine 4 at substantially opposite positions in the radial direction of the rock drilling machine 4. In this way the at least one second low pressure port 32, the at least one second low pressure channel 33 and the at least one second low pressure accumulator 34 may be provided in the rock drilling machine 4 in a simple way. However, the at least one second low pressure channel 33 could also extend in a direction which deviates from the exact axial direction of the rock drilling machine 4 and still the advantageous effects against the cavitation effect would be achieved.

In the embodiment of FIG. 3, the at least one first low pressure channel 30 is arranged to extend substantially in the radial direction of the rock drilling machine 4 from the at least one first low pressure port 29 to the outer circumference of the frame 11 of the rock drilling machine 4. Furthermore, the at least one second low pressure channel 33 is arranged to extend at the position of the front pressure chamber 16*b*.

In the embodiment of FIG. 3, the second low pressure channel 33 includes two portions, i.e. a first portion 33*a* extending substantially in the axial direction of the rock drilling machine 4 away from the second low pressure port 32 to a position at the front pressure chamber 16*b* and a second portion 33*b* extending substantially in the radial direction of the rock drilling machine 4 from the first portion 33*a* towards the outer periphery of the rock drilling machine at the position of the front pressure chamber 16*b*.

The second low pressure accumulator 34 is connected to the second portion 33*b* of the second low pressure channel 33 at the outer periphery of the frame 11 of the rock drilling machine 4. The at least one first low pressure accumulator 31 is thus positioned at the rear pressure chamber 16*a* and the at least one second low pressure accumulator 34 is positioned at the front pressure chamber 16*b*. However, the implementation of the first 30 and second 33 low pressure channels as well as the positioning of the first 31 and second 34 low pressure accumulators could also vary from that disclosed in FIG. 3.

Furthermore, in the radial direction of the frame 11 of the rock drilling machine 4 of the embodiment of FIG. 3, the at least one second high pressure port 24 is arranged substantially opposite to the at least one first high pressure port 21, wherein, in the axial direction of the rock drilling machine 4, the at least one first high pressure accumulator 23 and the at least one second high pressure accumulator 26, as well as the at least one first low pressure accumulator 31 and the at least one second low pressure accumulator 34, are positioned mutually crosswise at substantially opposite positions in the radial direction of the rock drilling machine 4. Accordingly, the low pressure accumulators 31, 34 and the high pressure accumulators 23, 26 are arranged at the outer circumference of the rock drilling machine 4 in such a way that the lengths of respective pressure channels remain as short as possible in the circumferential direction of the frame 11 of the rock drilling machine 4 in order to ensure effective operation of the respective pressure accumulators.

In the embodiment of FIG. 3, the control valve 20 is positioned between the percussion piston 17 and a stationary cylinder 35, which includes a first part 35*a* positioned substantially at the rear pressure chamber 16*a* and a second part 35*b* positioned substantially at the front pressure chamber 16*b*. The cylinder 35 may also contribute to divide the pressure chamber 16 into the rear pressure chamber 16*a* and the front pressure chamber 16*b*.

The control valve 20 has openings 36, 37 and the cylinder 35 has openings 38, 39, wherein when the control valve 20 moves with respect to the cylinder 35 during the operation of the impact device 12, the control valve 20 controls the flow of the pressure medium through the openings 36, 37, 38, and 39 and thereby through the ports 24, 27, 29 and 32 for controlling the pressure affecting in the rear pressure chamber 16*a*. The cylinder 35 also includes an opening 40, which provides a flow connection between the first high pressure port 21 and the front pressure chamber 16*b*.

The embodiment of the control arrangement having the control valve 20 and the cylinder 35 as disclosed in FIG. 3 is only one possible implementation for the control arrangement to be used in the impact device 12, and the actual implementation of it may thus vary from that disclosed in FIG. 3.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

The invention claimed is:

1. A breaking device comprising:

a frame;

an impact device including a pressure chamber and a percussion piston arranged to divide the pressure chamber into a rear pressure chamber and a front pressure chamber;

at least one first pressure port in the frame at the rear pressure chamber and at least one first pressure channel extending from the at least one first pressure port to an outer circumference of the frame of the breaking device;

at least one first pressure accumulator connected to the at least one first pressure channel at the outer circumference of the frame;

at least one second pressure port in the frame at the rear pressure chamber radially opposite from the at least one first pressure port;

at least one second pressure channel extending from the at least one second pressure port to the outer circumference of the frame;

at least one second pressure accumulator connected to the at least one second pressure channel at the outer circumference of the frame, wherein the at least one second low pressure channel is arranged to extend at least partly in an axial direction of the breaking device, whereby the at least one first pressure accumulator and at least one second pressure accumulator are arranged at the outer circumference of the frame at different positions in the axial direction of the breaking device;

at least one third pressure port in the frame at the front pressure chamber and at least one third pressure channel extending from the at least one third pressure port to the outer circumference of the frame, at least one third pressure accumulator connected to the at least one third pressure channel at the outer circumference of the frame; and at least one fourth pressure port in the frame at the rear pressure chamber and at least one fourth pressure channel extending from the at least one fourth pressure port to the outer circumference of the frame, and at least one fourth pressure accumulator connected to the at least one fourth pressure channel at the outer circumference of the frame, wherein the at least one third pressure channel and the at least one fourth pressure channel are arranged to extend substantially in the radial direction of the frame from the at least one third pressure port and from the at least one fourth pressure port to the outer circumference of the frame, the at least one third pressure accumulator being positioned at the front pressure chamber and the at least one fourth pressure accumulator being positioned at the rear pressure chamber.

2. The breaking device as claimed in claim 1, wherein the at least one second pressure channel is arranged to extend in the axial direction of the breaking device from the at least one second pressure port-towards the front pressure chamber, the at least one first pressure accumulator and at least one second pressure accumulator being arranged at the outer circumference of the frame of the breaking device at substantially opposite positions in the radial direction of the frame of the breaking device.

3. The breaking device as claimed in claim 1, wherein the at least one first pressure channel is arranged to extend substantially in a radial direction of the frame of the breaking device from the at least one first pressure port to the outer circumference of the frame of the breaking device and the at least one second pressure channel is arranged to extend at a position of the front pressure chamber, the at least one first pressure accumulator being positioned at the rear pressure chamber and the at least one second pressure accumulator being positioned at the front pressure chamber.

4. The breaking device as claimed in claim 1, wherein the at least one third pressure port and the at least one fourth pressure port are arranged at substantially opposite positions in the radial direction of the frame of the breaking device.

5. The breaking device as claimed in claim 2, wherein in the axial direction of the breaking device, the at least one first pressure accumulator and the at least one second pressure accumulator, as well as the at least one third pressure accumulator and the at least one fourth pressure accumulator are positioned mutually crosswise at substantially opposite positions in the radial direction of the frame of the breaking device.

6. The breaking device as claimed in claim 1, wherein the impact device includes at least one control valve contributing to divide the pressure chamber into the rear pressure chamber and the front pressure chamber, the at least one control valve having a number of openings for controlling the flow of pressure medium in the rear pressure chamber through the pressure ports.

7. The breaking device as claimed in claim 6, wherein the control valve is positioned between the percussion piston and a stationary cylinder having openings, the control valve being arranged to move with respect to the cylinder for controlling the flow of the pressure medium through the valve and cylinder openings and thereby through the ports for controlling the pressures in the rear pressure chamber.

8. The breaking device as claimed in claim 1, wherein the breaking device is a rock drilling machine.

9. The breaking device of claim 1, wherein the pressure of the first and second pressure accumulators is lower than the pressure of the third and fourth pressure accumulators.

* * * * *